US008011093B2

(12) United States Patent
Nakamura

(10) Patent No.: US 8,011,093 B2
(45) Date of Patent: Sep. 6, 2011

(54) METHOD OF MANUFACTURING CONNECTORS

(75) Inventor: Yoshio Nakamura, Kanagawa (JP)

(73) Assignee: Tyco Electronics Japan G.K., Kanagawa-ken (JP)

( * ) Notice: Subject to any disclaimer, the term of this patent is extended or adjusted under 35 U.S.C. 154(b) by 1468 days.

(21) Appl. No.: 11/289,734

(22) Filed: Nov. 29, 2005

(65) Prior Publication Data

US 2006/0112547 A1 Jun. 1, 2006

(30) Foreign Application Priority Data

Dec. 1, 2004 (JP) ..... 2004-348062

(51) Int. Cl.
*H01R 43/00* (2006.01)

(52) U.S. Cl. ..... 29/884; 29/827; 29/848; 29/874; 29/882

(58) Field of Classification Search ..... 29/564.6, 29/566.2, 566.3, 827, 848, 856, 874, 882–884; 206/390, 714, 716, 717; 439/604, 606, 607.01, 439/660, 736, 885

See application file for complete search history.

(56) References Cited

U.S. PATENT DOCUMENTS 5,619,794 A * 4/1997 Hokazono ..... 29/883
5,810,170 A * 9/1998 Alvite ..... 206/714

FOREIGN PATENT DOCUMENTS

| | | |
|---|---|---|
| JP | 10112370 | 4/1998 |
| JP | 2001-043952 | 2/2001 |
| JP | 2001043952 | 2/2001 |
| JP | 3338667 | 8/2002 |

* cited by examiner

*Primary Examiner* — Thiem Phan
(74) *Attorney, Agent, or Firm* — Barley Snyder LLC

(57) ABSTRACT

A method for manufacturing connectors comprises providing a carrier strip with a plurality of first alignment apertures and a plurality of contacts arranged in a row. The carrier strip is cut to desired lengths to form contact band pieces. The first alignment apertures are engaged with first protrusions on a carrier tape to mount each of the contact band pieces to the carrier tape. The first protrusions have a smaller outer diameter than an inner diameter of the first alignment apertures such that there is slight play there between. Resin is insert molded around the rows of the contacts to form a housing. The contacts are then cut from the carrier strip.

10 Claims, 4 Drawing Sheets

METHOD OF MANUFACTURING CONNECTORS

FIELD OF THE INVENTION

The invention relates to a method for manufacturing connectors. More particularly, the invention relates to a method for manufacturing connectors by insert molding wherein the connectors are molded by insert molding resin around rows of contacts arranged in a mold.

BACKGROUND OF THE INVENTION

One example of a conventional method for manufacturing connectors employing insert molding is disclosed in Japanese Patent No. 3338667. In this method, connected terminal pieces having a plurality of terminals are linked onto metallic bands at predetermined intervals. The metallic bands are intermittently conveyed as carriers. The connectors are manufactured by insert molding around rows of the terminals. Positioning apertures are formed in the connected terminal pieces, and small protrusions that correspond to the positioning apertures are formed on the metallic band. The connected terminal pieces are linked to the metallic bands by detachably swaging the protrusions and the apertures. Resin is injected into a mold having the rows of terminals arranged therein to form a housing. The connector formed by the resin and the rows of terminals is then removed from the metallic band, and the band-like substrates of the connected terminal pieces are cut off.

In the conventional method described above, it is not possible to reform the protrusions on the metallic band from which the connected terminal pieces have been removed. Therefore, the metallic bands are not reusable and must be discarded as scrap. Accordingly, it is necessary to manufacture new metallic bands, which increases the manufacturing cost of connectors. In addition, the positioning of the connected terminal pieces is performed by engaging and swaging the positioning apertures of the connected terminal pieces and the small protrusions on the metallic bands. There is therefore a possibility that positional displacement will occur due to gaps between the diameter of the apertures and the outer diameters of the protrusions. In other words, the positional relationships between the rows of contacts and the housing may be skewed.

BRIEF SUMMARY OF THE INVENTION

It is therefore an object of the invention to provide a method for manufacturing connectors, which reduces manufacturing costs. It is further an object of the invention to provide a method for manufacturing connectors, which positions rows of contacts accurately prior to insert molding. It is still further an object of the invention to provide a method for manufacturing connectors, which prevents positional shifting of the contacts in the connectors.

This and other objects are achieved by a method for manufacturing connectors comprising providing a carrier strip with a plurality of first alignment apertures and a plurality of contacts arranged in a row. The carrier strip is cut to desired lengths to form contact band pieces. The first alignment apertures are engaged with first protrusions on a carrier tape to mount each of the contact band pieces to the carrier tape. The first protrusions have a smaller outer diameter than an inner diameter of the first alignment apertures such that there is slight play there between. Resin is insert molded around the rows of the contacts to form a housing. The contacts are then cut from the carrier strip.

DETAILED DESCRIPTION OF THE INVENTION

Figure 1A:
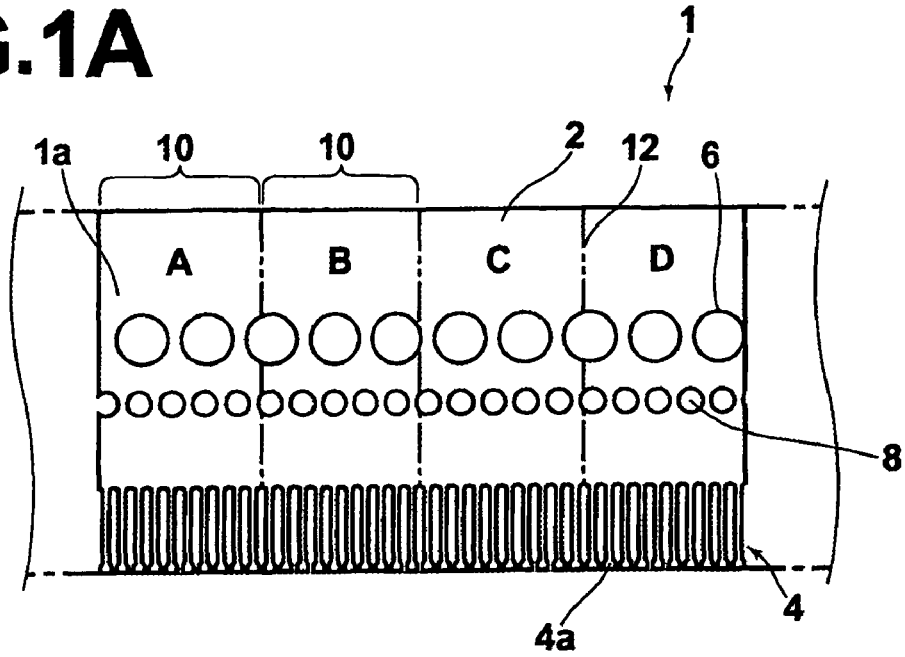
FIG. 1A is a partial magnified plan view of a contact band used in a method for manufacturing connectors according to the invention.
Figure 1B:
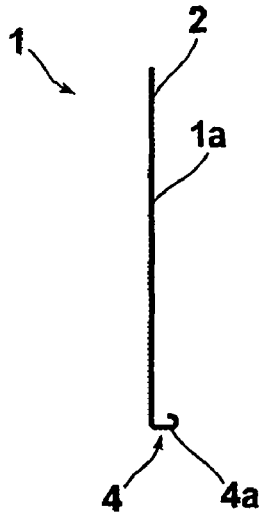
FIG. 1B is a partial magnified front view of the contact band in FIG. 1A.

A method for manufacturing connectors according to the invention will be described with reference to the attached drawings. FIGS. 1A-1B show a contact band 1. The contact band 1 includes a carrier strip 2 provided with a plurality of contacts 4 arranged in a row. The carrier strip 2 may be, for example, a metallic band. The contacts 4 are formed continuously at a predetermined pitch on one side of the carrier strip 2. Distal ends 4*a* of the contacts 4 are bent in a direction substantially perpendicular to a main surface 1*a* of the carrier strip 2 and then bent back toward the main surface 1*a*, as shown in FIG. 1B. Although all of the contacts 4 are shown as having the same shape, it will be appreciated by those skilled in the art that variations in shape may be possible.

First alignment apertures 6 are formed in the carrier strip 2 at a predetermined pitch along a longitudinal direction thereof. Second alignment apertures 8 are formed between the first alignment apertures 6 and the row of the contacts 4 at a uniform pitch along the longitudinal direction of the carrier strip 2. The second alignment apertures 8 have smaller diameters than the first alignment apertures 6 and are arranged at a narrower pitch than the first alignment apertures 6.

The contact band 1 is divided into contact band pieces 10 of desired lengths by cutting the carrier strip 2 at broken lines 12, which are substantially perpendicular to the longitudinal direction of the carrier strip 2. For example in FIG. 1A, the carrier strip 2 is cut into four contact band pieces 10, which are designated as A, B, C, and D. Each of the contact band pieces 10 has a pre-determined number of the contacts 4 thereon. The number of the contacts 4 on each of the contact band pieces 10 is determined by the connector in which the respective contact band piece 10 is to be used. In the illustrated embodiment, each of the contact band pieces 10 has the same number of the contacts 10 thereon.

Figure 2B:
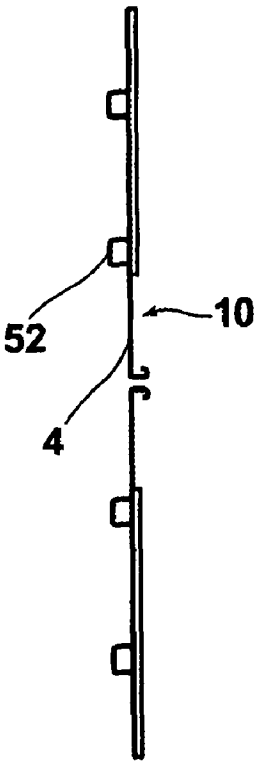
FIG. 2B is a front view of the adjacent substantially parallel carrier tapes of FIG. 2A.
Figure 2A:
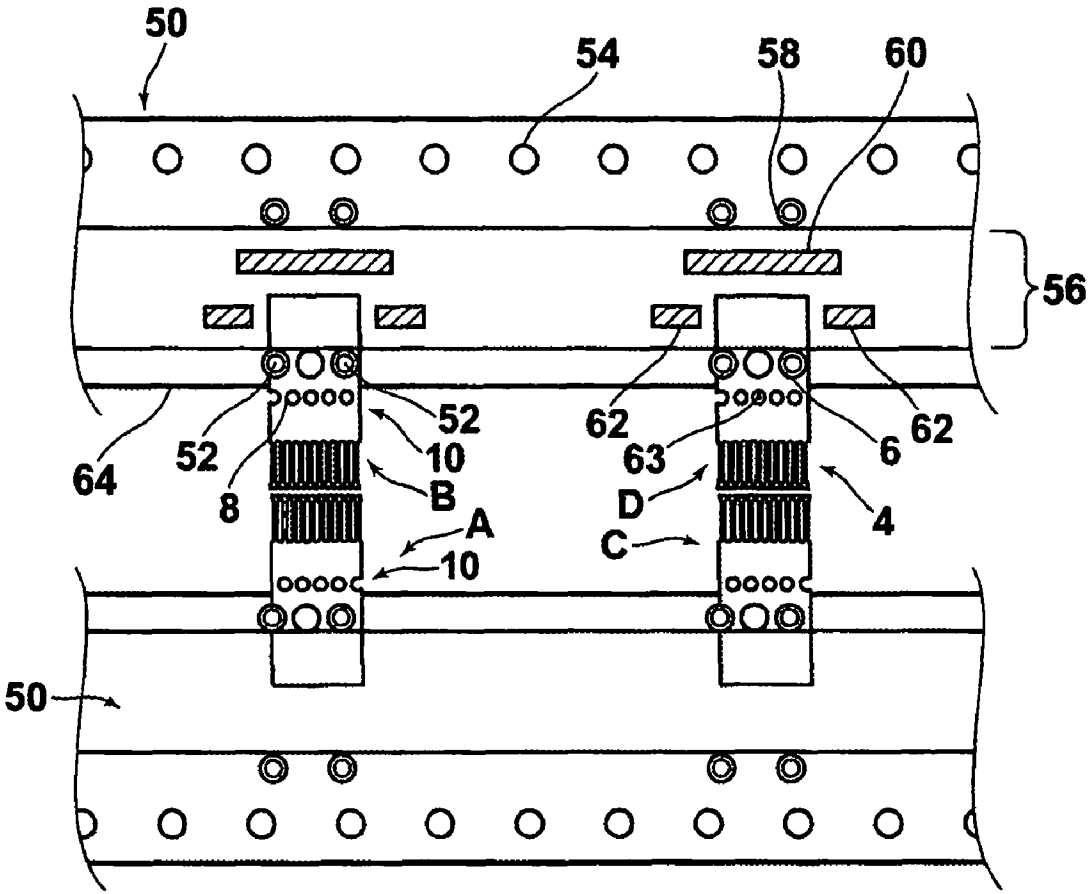
FIG. 2A is a plan view of adjacent substantially parallel carrier tapes with contact band pieces mounted at predetermined intervals thereon.

FIGS. 2A-3B show a pair of substantially parallel carrier tapes 50. Because the carrier tapes 50 in the illustrated embodiment are of the same construction, only one of the carrier tapes 50 will be described in further detail herein. As shown in FIG. 2A, the carrier tape 50 may be, for example, a non-metallic flexible planar band formed of paper or a resin such as polystyrene. A plurality of pairs of first protrusions 52 are formed at a predetermined pitch along a longitudinal direction of the carrier tape 50 in a vicinity of a first edge 64 that faces the other carrier tape 50. As shown in FIG. 2B, the first protrusions 52 are embossed in the carrier tape 50, for example, by a pressing mold (not shown) or pin (not shown). The outer diameters of the first protrusions 52 are slightly smaller than the inner diameters of the first alignment apertures 6. A plurality of pairs of second protrusions 58, which are similar to the first protrusions 52, are formed in a vicinity of a second edge opposite from the first edge 64 of the carrier tape 50 and are aligned in position with the first protrusions 52. Alignment apertures 54 are formed in a vicinity of the second edge of the carrier tape 50 at uniform intervals along the longitudinal direction thereof.

A state in which the contact band pieces 10, which have been cut from the contact band 1, are sequentially mounted onto the carrier tapes 50 will be described with reference to FIGS. 2A-2B. As shown in FIG. 2A, each of the contact band pieces 10 are positioned on the carrier tape 50 such that the first protrusions 52 and the first alignment apertures 6 are aligned with each other. The first protrusions 52 are inserted into the first alignment apertures 6 but are not swaged. Because the inner diameters of the first alignment apertures 6 are slightly greater than the outer diameters of the first protrusions 52, the first protrusions 52 have some play when inserted into the first alignment apertures 6. The second alignment apertures 8 are provided outside the first edge 64 of the carrier tape 50. The contact band pieces 10 may be provided on the carrier tapes 50, for example, such that piece A faces piece B and piece C faces piece D. Fluctuation in the shapes and dimensions of the contacts 4 can thereby be prevented, particularly between adjacent pairs of the rows of the contacts 4.

A cover tape 56 is provided on the carrier tape 50 in order to prevent the contact band pieces 10 from disengaging from the first protrusions 52. The cover tape 56 is a thin tape formed, for example, from a resin and is provided between the first protrusions 52 and the second protrusions 58. The cover tape 56 is attached to the carrier tape 50, for example, by heat and is guided by the first and second protrusions 52, 58. For example, in the illustrated embodiment, portions 60, 62, which are indicated by hatching in FIG. 2A, are fused to the carrier tape 50, for example, by ultrasonic welding or the like. The cover tape 56 presses the contact band pieces 10 against the carrier tape 50. The contact band pieces 10 are capable of moving slightly in the longitudinal direction of the carrier tape 50 even when held by the cover tape 56, due to the play in the engagement between the first protrusions 52 and the first alignment apertures 6.

Figure 3B:
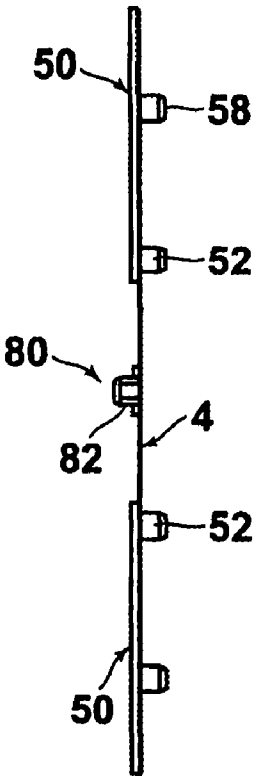
FIG. 3B is a front view of the adjacent substantially parallel carrier tapes of FIG. 3A.
Figure 3A:
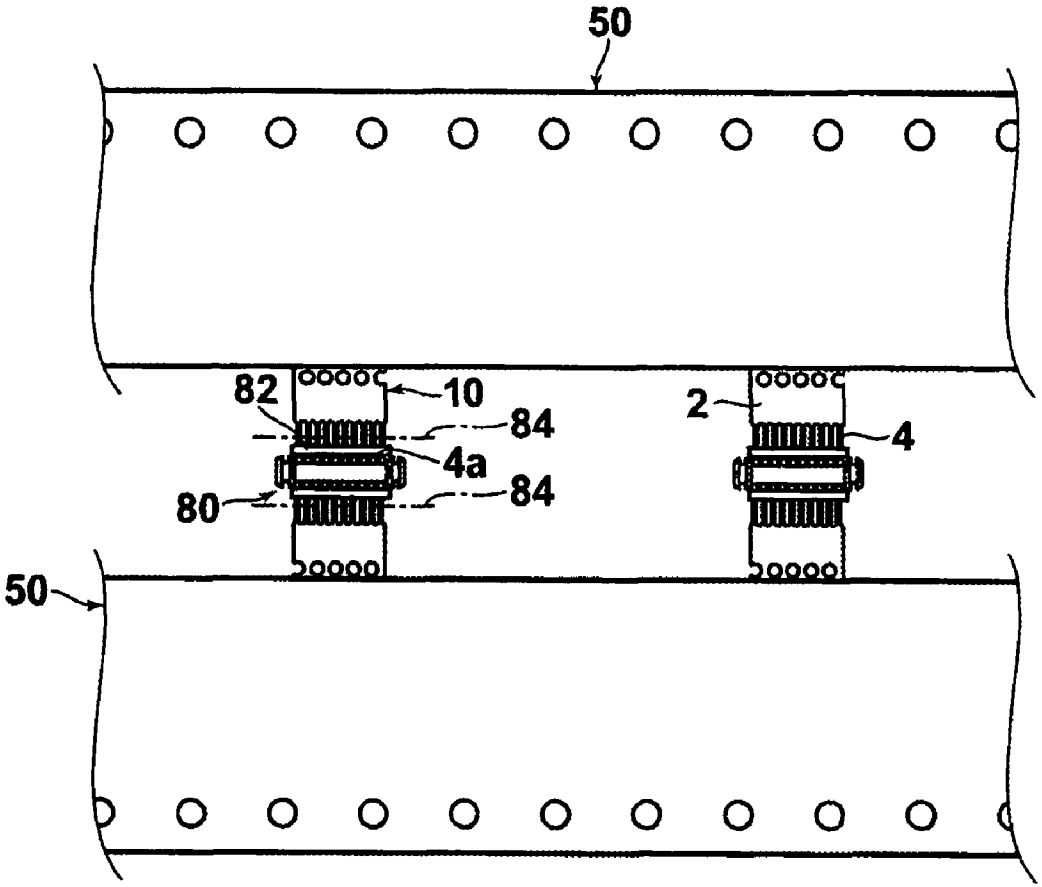
FIG. 3A is a bottom view of the adjacent substantially parallel carrier tapes with contact band pieces mounted at predetermined intervals thereon after being molded.

In this state, the contact band pieces 10 are placed within a mold (not shown) and resin is insert molded around the distal ends 4*a* of the contacts 4 to form connectors 80 having housings 82, as shown in FIGS. 3A-3B. Positioning pins 63 finely adjust the positions of the contact band pieces 10 prior to insert molding by engaging the second alignment apertures 8. The positioning pins 63 are provided within the mold (not shown), and a plurality of the positioning pins 63 may be provided for each of the contact band piece 10.

The connectors 80 are separated from the carrier strip 2, for example, by cutting the contacts 4 at lines 84. Either a single connector 80 or a plurality of connectors 80 may be formed within the mold in a single operation. Because there are no fluctuations in the shapes and dimensions of the contacts 4 within a single connector 80 due to the arrangement of the contact band pieces 10, as previously discussed, and because the second alignment apertures 8 and the positioning pins 63 finely adjust the position of the contacts 4, the connectors 80 can be precisely manufactured. Additionally, the contact band pieces 10 can be easily removed from the carrier tapes 50 after manufacturing the connector 80 such that the carrier tapes 50 can be reused. Therefore, the carrier tapes 50 are not discarded as scrap and the manufacturing costs can be reduced.

Figure 4A:
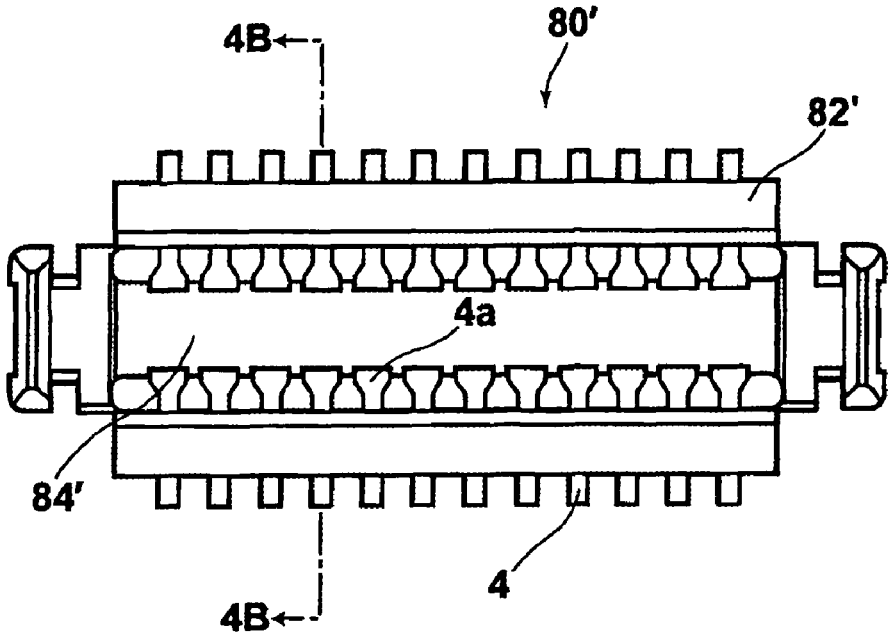
FIG. 4A is a plan view of a connector manufactured according to the manufacturing method of the invention.
Figure 4B:
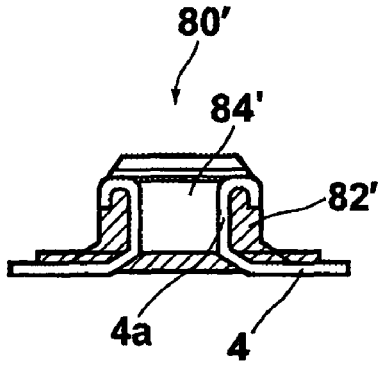
FIG. 4B is a sectional view taken along line 4B-4B of FIG. 4A.

FIGS. 4A-4B show an example of a connector 80' formed by the method previously discussed. The connector 80' comprises an insulative housing 82', which was formed by insert molding around the contacts 4. The housing 82' has an engaging opening 84' for engaging with another connector. The distal ends 4*a* of the contacts 4 are exposed within the engaging opening 84'. The contacts 4 are positioned such that each of the contacts 4 of each of the rows faces one of the contacts 4 of the other row. The connector 80' illustrated in FIGS. 4A-4B is a 24-pole connector with twelve of the contacts 4 on each side thereof. Accordingly, each of the contact band pieces 10 used to form the connector 80' had twelve of the contacts 4.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. A method for manufacturing connectors, comprising:

providing a carrier strip with a plurality of first alignment apertures and a plurality of contacts arranged in a row;

cutting the carrier strip to desired lengths to form contact band pieces;

attaching a cover tape to the contact band pieces to hold the contact band pieces between the cover tape and a non-metallic carrier tape;

providing the carrier tape with second protrusions and guiding the cover tape between first and second protrusions;

engaging the first alignment apertures with the first protrusions on the carrier tape to mount each of the contact band pieces to the carrier tape, the first protrusions having a smaller outer diameter than an inner diameter of the first alignment apertures such that there is play therebetween;

insert molding resin around the rows of the contacts to form a housing; and cutting the contacts from the carrier strip.

2. The method of claim 1, wherein the contact band pieces can move in a longitudinal direction with respect to the carrier tape when engaged with the cover tape due to the first protrusions having the smaller outer diameter than the inner diameter of the first alignment apertures.

3. The method of claim 1, further comprising removing the contact band pieces from the carrier tape.

4. The method of claim 3, further comprising reusing the carrier tape after removing the contact band pieces.

5. The method of claim 1, further comprising providing a plurality of second alignment apertures in the carrier strip and inserting positioning pins of a mold into the second alignment apertures before insert molding the resin.

6. The method of claim 5, wherein the second alignment apertures are arranged at a smaller pitch than the first alignment apertures and positioning pins that engage with the second alignment apertures, prior to insert molding the resin.

7. The method of claim 1, wherein two of the carrier tapes are provided parallel to each other at a predetermined distance and the contact band pieces are arranged facing each other.

8. The method of claim 7, wherein the contact band pieces facing each other are insert molded into the same housing.

9. The method of claim 8, wherein the contact band pieces facing each other are cut from the same carrier strip.

10. The method of claim 1, wherein the carrier strip is metallic.

* * * * *